US012458127B2

(12) United States Patent
Blagg

(10) Patent No.: US 12,458,127 B2
(45) **Date of Patent: *Nov. 4, 2025**

(54) INSECT REPELLENT AND SUNSCREEN APPLICATOR

(71) Applicant: Mary Diane Blagg, Hot Springs, AR (US)

(72) Inventor: Mary Diane Blagg, Hot Springs, AR (US)

( * ) Notice: Subject to any disclaimer, the term of this patent is extended or adjusted under 35 U.S.C. 154(b) by 573 days.

This patent is subject to a terminal disclaimer.

(21) Appl. No.: 17/863,290

(22) Filed: Jul. 12, 2022

(65) Prior Publication Data

US 2022/0346524 A1 Nov. 3, 2022

Related U.S. Application Data

(63) Continuation-in-part of application No. 17/511,172, filed on Oct. 26, 2021, now Pat. No. 12,029,872.

(60) Provisional application No. 63/123,713, filed on Dec. 10, 2020.

(51) Int. Cl.
*A45D 40/04* (2006.01)
*A45D 34/04* (2006.01)

(52) U.S. Cl.
CPC ..... *A45D 34/04* (2013.01); *A45D 2200/1009* (2013.01)

(58) Field of Classification Search
CPC ..... A45D 34/04; A45D 34/045; A45D 2200/1009; A45D 2200/1018; B65D 47/42
USPC ..... 401/130, 266
See application file for complete search history.

(56) References Cited

U.S. PATENT DOCUMENTS

| | | | | |
|---|---|---|---|---|
| 1,318,256 | A | 10/1919 | Birsan | |
| 1,532,830 | A | 4/1925 | Marceau | |
| 1,534,259 | A * | 4/1925 | Dempsey | B24D 15/00 15/209.1 |
| 1,553,049 | A | 9/1925 | Romero | |
| 1,818,340 | A | 8/1931 | Lemoine | |
| 2,919,703 | A | 1/1960 | Pinteau | |
| 3,466,131 | A | 9/1969 | Arcudi | |
| 3,704,072 | A | 11/1972 | Kaufman | |
| 4,148,318 | A | 4/1979 | Meyer | |
| 4,269,527 | A | 5/1981 | Lipfert | |
| 4,557,620 | A | 12/1985 | Hancy | |
| 4,617,875 | A | 10/1986 | Holland | |

(Continued)

*Primary Examiner* — Jennifer C Chiang
(74) *Attorney, Agent, or Firm* — Stephen D. Carver

(57) ABSTRACT

A portable applicator for uniformly applying insect repellent or sunscreen upon human skin. A jar-like container normally holds the liquid contents. The container is sealed by a circular lid. The lid supports a downwardly-projecting sponge wiper that is saturated with liquid for subsequent topical application. The underside of the lid has a peripheral ring for frictionally securing the wiper, with ribs defining channels therebetween for directing fluid. A wringer-saturator, in the form of a foraminous partition, is disposed between the applicator contents and the wiper. When the applicator is closed, the wiper is compressed slightly by contact with the wringer-saturator. As the lid is removed from the container, the wiper will expand slightly, absorbing and holding liquid. When the lid is reattached, the wiper is compressed slightly against the wringer-saturator and liquid is partially expelled. The wiper has a fiberglass fabric covering for preventing dripping and easing topical application.

3 Claims, 11 Drawing Sheets

(56) References Cited

U.S. PATENT DOCUMENTS

| | | | | |
|---|---|---|---|---|
| 4,752,147 | A * | 6/1988 | Persi | B05C 17/00 401/126 |
| 5,019,033 | A | 5/1991 | Geria | |
| 5,865,194 | A | 2/1999 | Gueret | |
| 6,009,885 | A | 1/2000 | Nam | |
| 6,715,951 | B2 * | 4/2004 | Gueret | A45D 34/045 401/126 |
| 7,040,828 | B2 * | 5/2006 | LaPointe | B44D 3/12 401/126 |
| 7,201,525 | B2 | 4/2007 | Mohiuddin | |
| 7,866,907 | B2 | 1/2011 | Cable | |
| 8,651,119 | B2 | 2/2014 | Byun | |
| 9,833,809 | B2 * | 12/2017 | Feddes | B65D 35/36 |

* cited by examiner

INSECT REPELLENT AND SUNSCREEN APPLICATOR

CROSS-REFERENCE TO RELATED APPLICATION

This utility patent application is based upon and claims priority from previously filed utility conversion application Ser. No. 17/511,172, Filed 26 Oct. 2021, and entitled "Insect Repellent and Sunscreen Applicator," which in turn was based on prior Provisional Patent Application Ser. No. 63/123,713, filed Dec. 20, 2020, and entitled "Insect Repellent and Sunscreen Applicator," both by inventor Mary Diane Blagg, an American Citizen, and priority is claimed from said prior filings.

BACKGROUND OF THE INVENTION

I. Field of the Invention

The present invention relates to applicators for the safe and efficient topical application of bug and insect repellents, and sunscreens. More particularly, the present invention relates to liquid repellent applicators of the type comprising a closed system container, a removable closure, and skin contacting structure secured to the closure for absorbing and then applying liquid repellent to the human skin. Prior art germane to the invention can be found in United States Patent Classes 132 and 401.

II. Description of the Prior Art

It is well recognized that certain annoying insects, such as mosquitoes, can transmit various diseases such as malaria. Insect repellents protect human health by minimizing the transmission of germs and viruses that can transmit Lyme disease, Zika, the West Nile virus, encephalitis, malaria, and the serious Alphagal syndrome, which is a recently identified type of food allergy that most often begins when a Lone Star tick bites someone. The bite transmits a sugar molecule called "alpha-gal" into the person's body. Lyme disease is spread by tick bites. Pest insects have long been carriers and spreaders of diseases as they not only feed on animals, but on humans as well.

In North America, mosquitoes, ticks, and black flies are the three major groups of arthropods pestiferous to humans. While black flies and mosquitoes in North America are primarily a nuisance, a tick bite can be more serious. In particular, significant attention in the northeast United States recently has been focused upon the Lyme disease ticks (ixodes damini) which have spread in geographical area as well as in number, and which carry the potentially debilitating Lyme disease. Similarly, in warmer climates such as Latin America, a serious and potentially fatal malady known as Chagas' disease are carried by triatomes (Chagas bugs) which are active at night and feed on people as they sleep. In Africa, mosquitoes carry malaria. It has been suggested, although yet unproven, that the recently ubiquitous Covid 19 disease may also be spread by insects including mosquitoes.

CDC scientists analyzed data reported to the National Notifiable Diseases Surveillance System for sixteen vector-borne diseases from 2005 to 2020 to identify trends. Many infections are not reported or recognized, so it has been difficult to accurately estimate the overall cost and burden of these diseases. In 2016 the most common tick-borne diseases in the U.S. were Lyme diseases and ehrlichosis/anaplasmosis. The most common mosquito-borne diseases were West Nile virus, dengue fever, and Zika. The increases in diseases caused by mosquitoes, ticks, and/or fleas in the U.S. is due to many factors. These insects are spreading beyond their former geographic boundaries increasing he likelihood of exposure to diverse populations. Overseas travelers can be infected unknowingly with a mosquito-transmitted disease like Zika, and then carry it back home. In addition, transmissions of previously unrecognized germs has occurred. Mosquitoes and ticks can spread viruses in the same manner that travelers subjected to the SARS and Corona or Covid-19 viruses contaminate others. By nature, if unconstrained, vector-borne viruses and diseases will only worsen without treatment.

Recent studies concluded that approximately one million cases of disease caused by mosquitoes, ticks or fleas were reported in the U.S. from 2005 to 2020, and these diseases can cause debilitating neurological symptoms. Mosquitoes transit disease to more than 700 million persons annually. Arboviruses transmitted by mosquitoes cause considerable outbreaks of eastern equine encephalitis, western equine encephalitis, St. Louis encephalitis, and La Cross encephalitis.

One increasingly common medical condition transmitted by ticks is "alpha-gal syndrome," which is a type of food allergy to red meat and other products made from mammals. In the United States this condition most often begins after a bite from a Lone Star tick. The bite transmits a sugar molecule called alpha-gal into the body of the victim. In some people this triggers an immune response reaction that later produces mild to severe allergic reactions to red meat such as beef, port or lamb and other animal products. The Lone Star tick that has previously bitten an animal is exposed to the alph-gal sugar molecule, and transfers it to the next bitten animal or human. The Lone Star tick is found mostly in the Southeastern United States, where most cases of alpha-gal syndrome are reported. The tick is also found in the eastern and south central regions of the United States. The condition is also being detected in the northern and western regions of the country, as deer carry the tick to new places. Alpha-gal syndrome also has been diagnosed in Europe, Australia and Asia where other types of ticks are responsible. Researchers now believe that some people who have frequent unexplained anaphylactic reactions, and who test negative for other food allergies may also be infected with the alpha-gal syndrome. There is no known treatment other than avoiding red meat and other mammalian-derived food products.

Furthermore, in the fall of 1999, the west Nile virus transmitted by mosquitoes, were detected for the first time in the Western Hemisphere. In the New York City area, sixty-two persons infected with the West Nile virus were hospitalized, and seven persons died. The CDC estimates that more than 2000 persons were infected with the West Nile virus in the year 2000. The virus has now been detected in twenty seven states, and it continues to spread. As recently as 2017 a huge Zika outbreak inside Florida, affecting tourism. In the summer of 2019, mosquitoes carrying the Eastern Equine encephalitis virus threatened the north-eastern United States and several people were infected.

According to The FDA, CDC, and *Consumer Reports Magazine*, studies have shown that natural repellent oils such as citronella, eucalyptus, lemon leaves, peppermint, lavender, and cedar and permethrin and various perfumed botanicals give limited protection, sometimes lasting for only one or two hours. Picaridin, which has been offered in the USA since 2005, is the most effective non-DEET repellent. Picaridin, also known as icaridin in the piperidine chemical family, is derived from the piper plant. It can be applied directly to skin or clothing. It has broad efficacy against various insects such as mosquitoes, ticks, gnats, flies and fleas, and is almost colorless and odorless. A study performed in 2010 showed that Picaridin spray and cream at a 20% concentration provided twelve hours of protection against ticks. Icaridin does not dissolve plastics, synthetics or sealants. While picaridin offers more repellent effectiveness that other botanicals, its fumes can burn or irritate the human eyes because it is based upon pepper extracts. Thus children should not be treated with picaridin.

DEET was developed for use in jungle warfare in the Pacific Theater in World War Two. The CDC, the U.S. Department of Health and Human Services, the NIH, the FDA, the EPA, the American Association of Pediatrics and the American Medical Association report that DEET, when properly used, is the safest and most effective repellent, exhibiting no contrary health indications after seventy-five years of use and testing. In the mid 1990's, and as recently as 2015, DEET was tested and found safe and non-carcinogenic. It is not a health risk to children and it can be used with children over two months old. It was deemed "safe" by the American Association of Pediatrics.

However, DEET-based products should not be overused on the skin or ingested. It is recommenced by the by the U.S. Department of Human Services and the CDC that fumes should not be inhaled or swallowed and eye contact must be avoided and it should not contact open wounds. Most recent DEET tests reveal that mixtures carrying in excess of 50% by volume yield diminishing returns. A twenty to forty percent concentration is ideal for nearly a full day of significant protection, with reapplication recommended after four to six hours. A seven percent concentration provides around two to three hours of protection. However, highly concentrated DEET mixtures can be worthwhile in dense forests and hot, humid jungle environments. The Entomological society of America and studies by American universities which received grants for insect repellent studies found that mosquitoes and ticks were strongly repelled by DEET mixtures, which functions for significant time periods.

The physical form of known repellents includes liquids, lotions, creams, sprays and the like. Spraying repellents requires going outdoors, resulting in streaks and necessitating rubbing and spreading with the hands. Lotions or creams generally require a user contact a large quantity of lotion on a hand and then wipe or rub it across all exposed skin to be protected. This requires the user to repeatedly place lotion on their hand for continued wiping, often resulting in an unwanted mess, inconvenience, and incomplete age; therefore typical users tends to omit reapplications. Almost one hundred percent protection from toxic bug bites and ultraviolet light can be acquired by correct application, involving the gentle rubbing and spreading of the product over exposed skin with the hands.

In general, repellent-laced clip-on products and other small attachment designs are generally ineffective beyond the immediate area around them. An effective DEET barrier is not obtained with these devices. In surveys it has been found that most users apply repellent hastily, if not haphazardly, with most omitting rubbing it over their skin evenly. In reality, some users grow impatient and omit bug repellent because of the trouble and inconvenience of conventional applicators, such as the irregular and imprecise age patterns of typical spray applicators, and the fear of breathing in fumes.

Many insect repellents are packaged in aerosol spray cans of typical commercial dimensions. Besides being bulky and generally inconvenient to carry, spray applicators often distribute repellent in an uneven manner, and often unintended targets are hit. Aerosol application problems may be acute when applying repellent to infants, or small children, and uncomfortable irritation may occur when spraying around the human face. Aerosol application is also disadvantageous because of the documented environmental consequences of aerosol Chloro Flouro Carbons ("CFC"). When an oily composition is sprayed upon the skin, the result is a greasy film which dries relatively slowly. When applying a more quick drying spray, it is difficult to produce a uniform coating. In order to coat the entire surface of an area of skin, it is necessary to liberally spray the entire area, often using an excessive volume of repellent, and wasting much of it.

Sunscreens are typically higher in viscosity than most insect-repellent liquid compositions. They are subject to strict CDC guidelines. It is recommended that sunscreens at a minimum of 15 SPF (i.e. "sun protection factor") should be applied every two hours. It takes only a few sunburn experiences for the risk of skin cancer to be increased demonstrably in later life, and severe melanoma can lead to loss of life. When engaging in outdoor activities requiring both insect repellent and sunscreens, the sunscreen is applied first and the repellent is applied afterwards.

Single use pre-moistened applicators contained in a compact, sealed package have been developed. Known commercial embodiments of such repellents include "wet-wipes". A wet wipe comprises a fabric-like article impregnated with a fluid, typically a surfactant and/or bactericide, and contained in a sealed package for a single use. When it is to be used, the sealed wet wipe package is torn open, and the single use moistened wipe removed, unfolded, and rubbed over the intended region of the skin. For large areas of skin several such wipes are needed, and it is a disadvantage that these typically include only a relatively small dose of repellent. An additional problem associated with many prior art applicators is that they are designed for and discarded after a single use. In addition to being economically disadvantageous, disposable applicators are environmentally troublesome. Further, should a user desire to make several separate applications during a day, for instance, a number of single use, multiple disposable applicators must be carried. Additionally aerosol spray cans of repellent can dangerously explode when left in a vehicle during the hot summer months, and pump-spray cans sometimes squirt excessively, causing repellent to drip about the skin, when overheated.

Many medical procedures involve the application of medicines, sterilizing fluids, antiseptics, gels, agents or other materials to portions of the body, such as the skin, for preparation, treatment, etc. Such medicines, sterilizing fluids, and similar agents are typically transferred to the skin via an applicator. Conventional liquid applicators may store liquids, and provide a sprayer function of some form for application. Alternatively liquid may be poured upon a swab, pad, or cotton-tip for subsequent direct topical application to the skin.

There are prior art attempts at containing various liquids and substances, such as cosmetics, for personal transportation and periodic discharge and application.

For example, U.S. Pat. No. 3,704,072 issued Nov. 28, 1972 discloses an analogous cleaning implement with enhanced scrubbing characteristics generated with the use of a cleansing compound or germicidal soaps. Action is generated with materials comprising a pored surface or a plurality of bristle-like elements, such as Velcro or brush bristles, that are used with a quantity of cleansing compound.

U.S. Pat. No. 4,148,318 issued Apr. 10, 1979 depicts an applicator tool for surgical preparations comprising an internal supply of antiseptic solution. The device has a reservoir from which and liquids may be applied to human skin with a sponge-like applicator element.

U.S. Pat. No. 4,269,527 issued May 26, 1981 discloses an applicator for pulverized substances. The applicator comprises a resilient container for pulverizable substance, a permeable membrane through which substances pass, and means for maintaining and releasing the pulverizable substance.

U.S. Pat. No. 4,557,620 issued Dec. 10, 1985 shows a cosmetic applicator which comprises a hand-sized storage container, a replaceable pad for applying the cosmetic, and a system of material carrying channels, a support screen, a flow limiter, a foam pad and a covering cloth.

U.S. Pat. No. 4,617,875 issued Oct. 21, 1986 discloses a grooming and treatment applicator with a circular housing for containing a liquid or powder for skin treatment, or insecticide, or a shampoo. Several alternative applicator face plates or heads are provided, with each having a brush, sponge, or other similar surface for engaging the hair, and with the face plates carrying nozzles extending for a distance substantially equal to the extremity of the brush or sponge, for example, and overlying the spaced openings.

U.S. Pat. No. 5,019,033 issued May 28, 1991 comprises a disposable, hollow bulb-shaped applicator with an ointment-permeable soft mesh membrane. Resilient walls surround and interconnect both ends of the applicator, and form a chamber for holding ointment. The ointment chamber may be filled by pressurizing the container (e.g. by squeezing) to force ointment from the container into the applicator.

U.S. Pat. No. 5,865,194 issued Feb. 2, 1999 provides a case for a cosmetic product in a powdery or semi-fluid form. The case has a rigid body, and a flexible bottom that define a variable volume compartment for containing product. The case also includes a fixed screen which allows the product to pass during simultaneous pressures on the flexible bottom and on the screen. The product can be a make-up or skin care powder.

U.S. Pat. No. 6,009,885 issued Jan. 4, 2000 discloses a powder puff case that permits face powder to directly and uniformly adhere to a powder puff through an adhesion net when turning upside down and shaking the powder case. Face powder directly and uniformly adheres through the adhesion net to the powder puff from the main body.

U.S. Pat. No. 7,201,525 issued Apr. 10, 2007 shows a solution applicator with a container, a head, and a cap. The head includes a top for use in applying the solution, a spike which pierces or opens a membrane, and at least one protrusion extending from the head. The head couples to a cap with complementary structure.

U.S. Pat. No. 7,866,907 issued Jan. 11, 2011 shows a medical skin applicator apparatus having a fluid chamber for storing a medical agent and an applicator coupled to the housing. The fluid housing has a penetrable wall to permit access to the fluid chamber and release of the medical agent. The applicator includes a surface for applying the medical agent to a patient.

U.S. Pat. No. 8,651,119 issued Feb. 18, 2014 shows a cosmetic case for a powder brush. A brush holder is rotated through a certain angle to an operational position to use the brush, and the brush may be taken out in an open state.

Other patents of possible interest include U.S. Pat. Nos. 1,318,256, 1,532,830, 1,553,049, 1,818,340, 2,919,703, 3,466,131, 3,704,072, 4,148,318, 4,269,527, 4,557,620, and 4,617,875.

SUMMARY OF THE INVENTION

This invention provides an applicator device with a self contained reservoir primarily for insect or bug repellents, such as liquid materials comprising DEET or the like, skin lotions and sunscreens.

The preferred invention comprises a handy and portable applicator for human use that uniformly applies insect repellent or sunscreen upon selected portions of skin. The applicator comprises a container that normally holds the liquid contents. The container may be threadably engaged by an upper, circular lid for closure. The lid functions as an applicator handle, but it may optionally include a separate handle portion. The lid supports a downwardly-projecting wiper, preferably comprising at least a portion of a sponge, that can be saturated with liquid for subsequent topical application of the applicator contents. The wiper contacts the underside of the lid, which may include raised, ribbed flutes and/or channels for aiding liquid circulation, and for preventing over-saturation of the wiper.

In assembly, a coaxially disposed, wringer-saturator, preferably in the form of a circular, foraminous partition, is disposed between the liquid in the applicator, and the wiper for maintaining proper liquid flow. The wringer-saturator may be firmly positioned and supported upon a ring formed within the container. Alternatively the wringer-saturator may be disposed upon vertical supports spacers or flutes. When the applicator is closed shut by the lid, the wiper is compressed slightly by contact with the wringer/saturator below it, when the container is upright. At a point before use of the product, the container is turned upside-down to direct the liquid into the wiper under the lid. Before the lid is removed when the container is back upright, the wiper will expand slightly, absorbing liquid from the container as the additional liquid will be further directed towards the wiper by channels or flutes (created by the raised ribs) in the lid underside to insure equal, even distribution of liquid to the wiper. At this point, the lid is removed and the wiper is ready for use. When the lid is tightly reattached, the wiper is compressed at least slightly against the partition where "wringing" occurs and some liquid is expelled from the wiper.

The wiper is provided with a fabric or garment-like, and preferably fiber-glass covering that smooths the "feel" experienced by a user. The covering also prevents deformation and expansion of the wiper over time. Further, the covering helps to prevent dripping, as the fiberglass lining has the propensity to retain liquid. In one form of the invention, the covering overlies the circular bottom and bottom periphery of the wiper. In alternative embodiments this covering may overlie and circumscribe a substantial length of the wiper, and in a preferred embodiment the covering shrouds the entire wiper exterior.

In the best mode known at this time, the covering comprises a fiberglass cloth of the type used for swimming pool linings, and has been found and proven through experiment to smoothly operate, i.e., it provides excellent, drip-free topical application and comfort. Additionally, the wiper surface area provides adequate coverage and its fiberglass sheath slides and glides ergonomically over all exposed skin and bony surfaces like knees, wrists and ankles.

The main objects of my invention are to provide a small, portable kit that enables extremely carefree, easy application of bug repellents and sunscreens, encourages use, and eliminates sometimes serious and fatal diseases caused by ticks, mosquitoes, and other insects.

Yet another important object is to eliminate or reduce sometimes serious and fatal diseases caused by ticks, mosquitoes, and other insects, as well as to reduce the deleterious effects of ultra-violet light which presents the risk of various skin cancers.

Another object is to provide such a kit that enables maximum protection and coverage with an extremely easy and care-free "no mess" and "no spray" application of bug repellents and sunscreens, that encourages consistent use and ultimately helps prevent users from omitting applications.

Another basic object is to provide a portable applicator for topical solutions such as bug/insect repellents, sterilizing substances such as rubbing alcohol, skin-care products, suntan creams or liquid preparations, and the like.

A similar object is to provide a reliable and comfortable topical applicator for a variety of insect or bug repellents, skin creams, cleansing and sanitizing substances, and suntanning products.

A fundamental object is to provide a repellent system for warding off bugs and insects, such as mosquitoes, flies, ticks including Lone Star ticks, triatomes (Chagas bugs) and the like.

Another object is to ease the application of sunscreens to encourage frequent use to prevent serious and sometimes fatal skin cancers.

Another primary object of the present invention to provide an applicator and enclosure that is readily adapted to function advantageously with a number of different liquid gels and blends that are adapted to function as insect repellents, germicides, skin creams, and/or sunscreens.

It is a further object of the present invention to provide a repellent applicator/container that is easily used and transported.

Another object is to make it easy to contain and apply bug repellents and sunscreens.

Another object is to provide an applicator that eliminates both the mess in application with hands and the harm of breathing vapors of the product that is always associated with spray and pump dispensers, therefore easing use, and encouraging users not to skip periodic re-applications.

A related object is to provide an applicator of the character described that facilitates the accurate and precise placement of desired quantities or amounts of product.

Another object is to provide a container with a removable lid that doubles as a handle for the precise topical coating of product upon the human skin.

A basic object is to provide an applicator for insect repellent for humans and animals for protecting against a diverse array of insects and pests.

It is also an object to provide an applicator of the character described that can be safely and effectively used and applied by children.

A collateral object is to provide a repellent applicator system of the character described that contains germicidal liquids that are toxic to germs and viruses such as the H1N1, Sars, and novel Covid-19 viruses.

It is also an object of my invention to provide a safe and easy-to-use applicator or dispenser of the character described that eliminates the danger of inhaling vapors. It is a feature of the invention that topical substances are manually applied with a wiper rather than using a spray system.

Finally it is my visionary and yet practical and attainable object to help prevent the toxic effects of bug bites and ultraviolet sun rays, both nationwide and globally, by providing an applicator that makes it a cinch and a "no-brainer" to employ without question.

These and other objects and advantages of the present invention, along with features of novelty appurtenant thereto, will appear or become apparent in the course of the following descriptive sections.

BRIEF DESCRIPTIONS OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
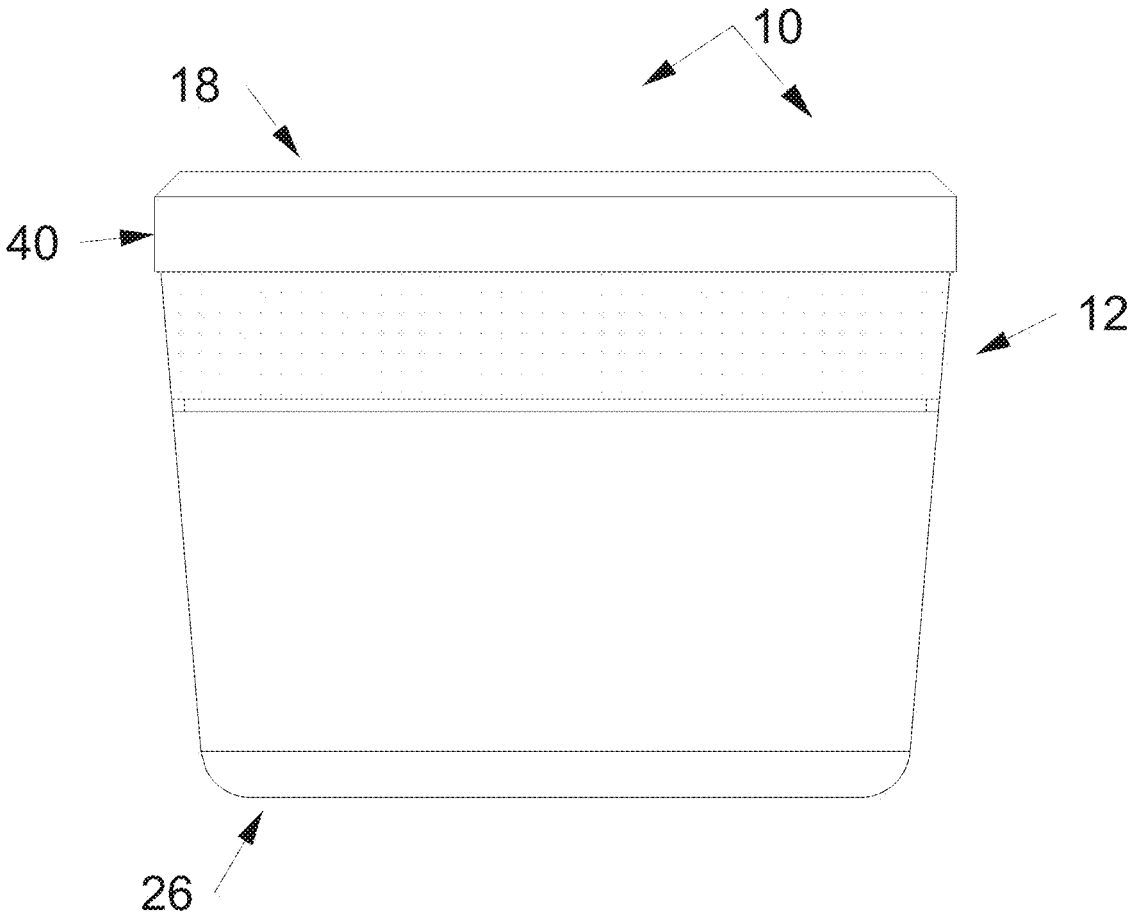
FIG. 1 is a plan view of an applicator constructed in accordance with the invention.
Figure 1A:
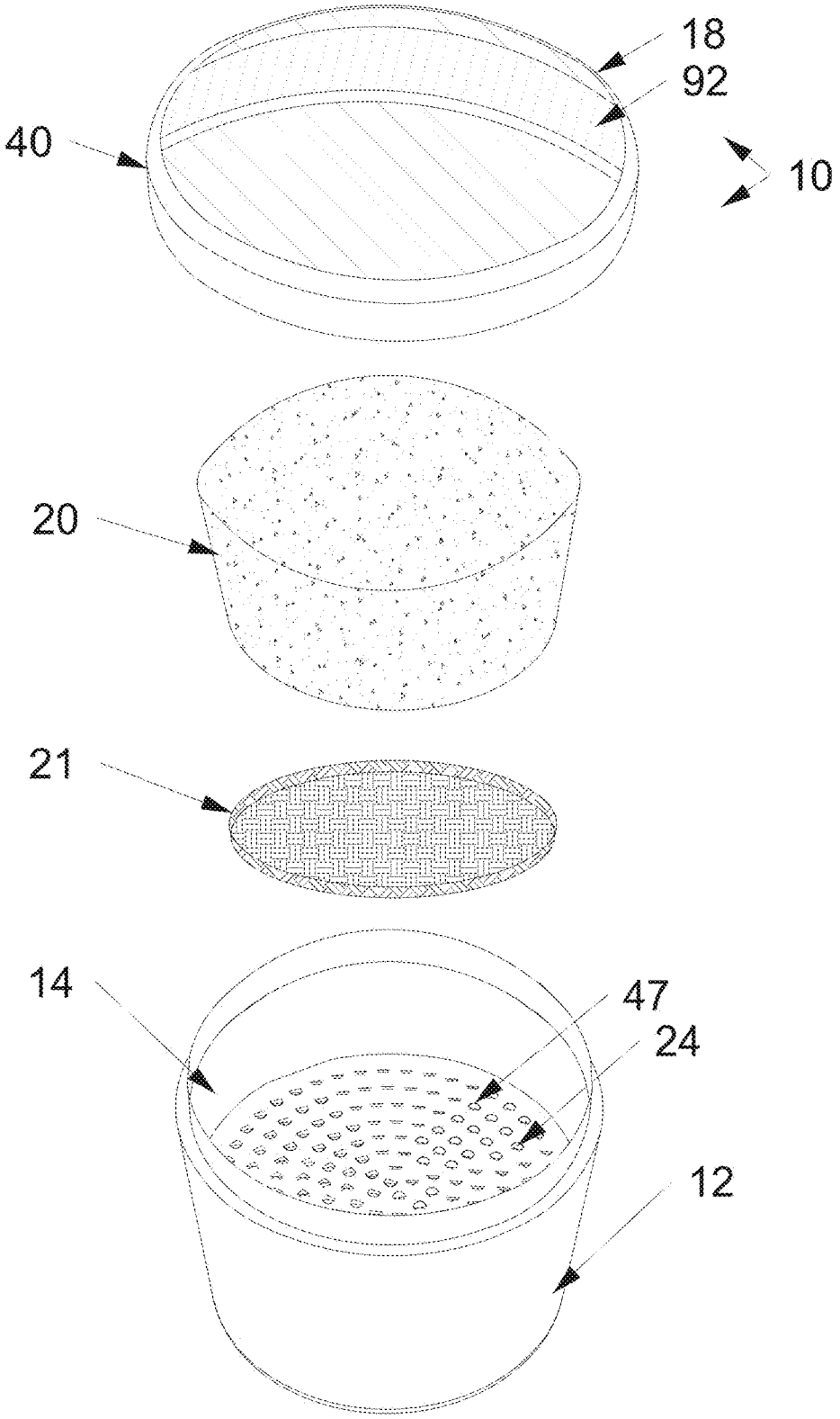
FIG. 1A is a partially exploded, isometric assembly view of a first applicator embodiment constructed in accordance with the teachings of the invention.

With initial reference now directed to FIGS. 1-5 of the appended drawings, an insect repellent applicator constructed in accordance with the a preferred mode of the invention has been generally designated by the reference numeral 10. There are multiple embodiments known at this time discussed hereinafter.

Figure 4:
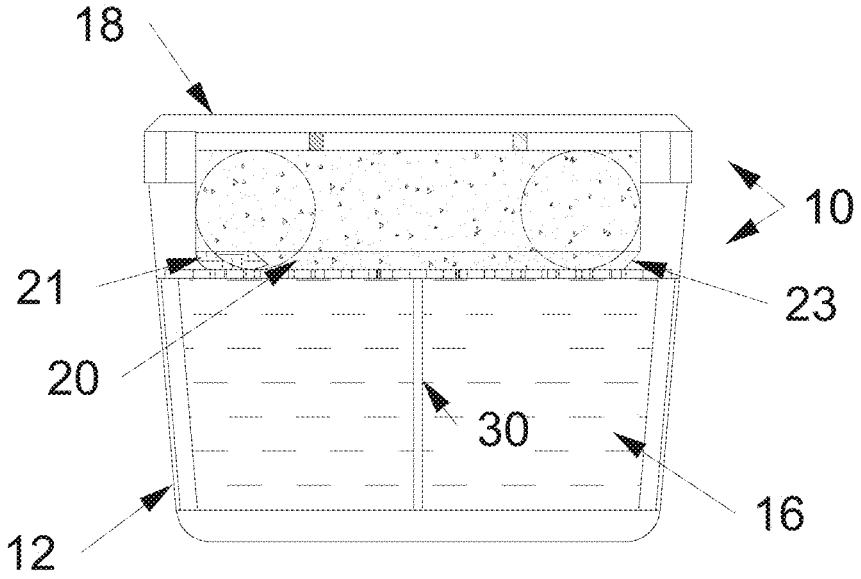
FIG. 4 is an enlarged, fragmentary longitudinal sectional view of the applicators of FIGS. 1-3.
Figure 5:
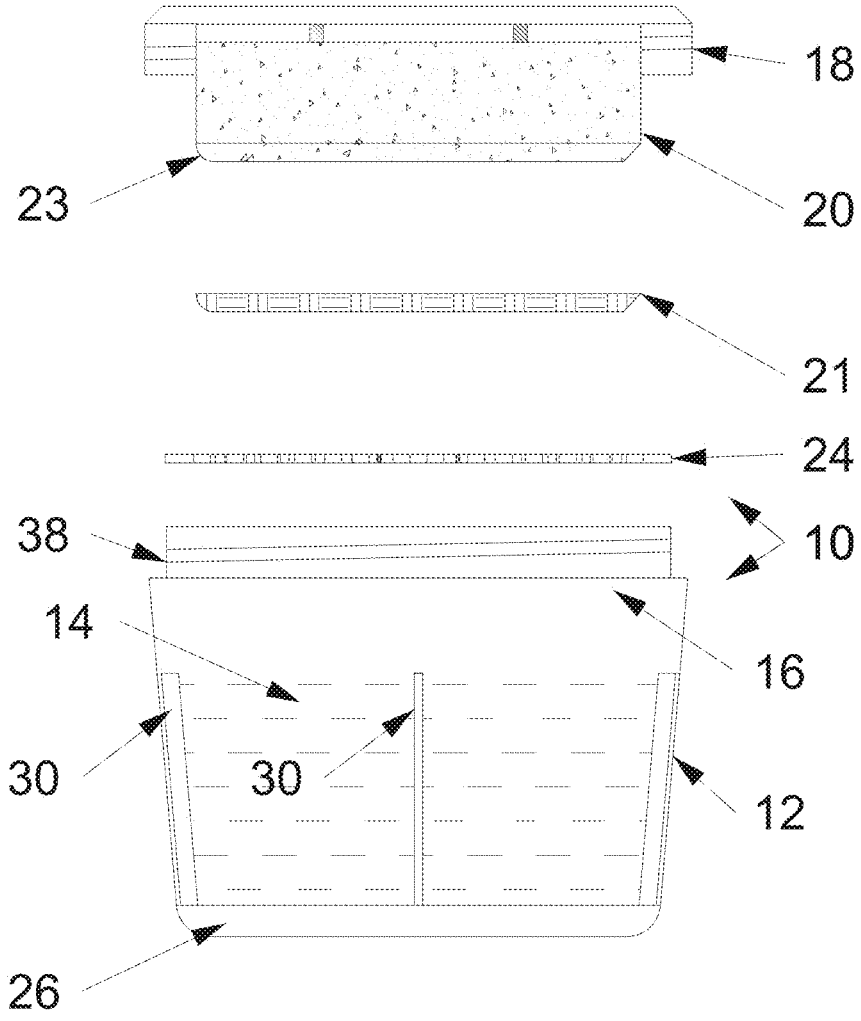
FIG. 5 is an exploded longitudinal sectional view of the applicator of FIGS. 1-4, with portions thereof shown in section for clarity.

Applicator 10 comprises a jar-like, preferably glass or plastic container 12 defining an interior 14 adapted to contain various liquids or substances to be used with the invention. These substances include liquids or creams of various viscosities, including as insect repellents, gels, suntan lotions, sterilizing agents, or disinfectants. In FIG. 4 the liquid contents of the applicator 10 has been generally designated by the reference numeral 16. Container 12 is preferably generally cylindrical, but it can be shaped substantially differently.

A substantially circular lid 18 is adapted to be threadably secured to the cylindrical container 12 for closure. Various differently shaped containers will of course require differently shaped lids. Furthermore, the lids do not have to be threadably attached, as, for example, they could be snap fitted. Importantly, lid 18 supports a downwardly projecting wiper 20 that is preferably concentrically positioned at and secured to the lid bottom, and which projects downwardly into the container interior 14. Preferably there is a thin, light-weight covering 21 shrouding the wiper, covering at least the circular periphery 23 (FIG. 2) and the bottom of wiper 20, but preferably covering most of the external surface of the wiper. The covering 21 is preferably made from fabric material, glass fiberglass material, thin fabric or garment materials, polyester, or linen materials, but fiberglass fabric is preferred. In the best mode known at this time, the covering 21 is made from plain weave, ten mil thick, six-ounce fiberglass cloth available from Fiberglass Warehouse, at https://fiberglasswarehouse.com/collections/fiberglass-cloth.

Once the lid 18 is removed from the container 12, it can function as a handle for applying the container contents. In other words, the lid 18 may be grasped while rubbing the wiper 20 upon the skin. However, the lid 18 may optionally include a separate, integral handle portion 92 (FIG. 1).

There is a wringer-saturator 24 preferably in the form of a circular, perforated, foraminous partition that can contact and at least partially compress wiper 20. The wringer-saturator 24 is secured beneath the lid 18 within the interior 14 of the container 12. As explained hereinafter, the partition 24 functions both as a wringer and saturator in operation. It may be pressed into the container 12 for a friction fit, where it may preferably be supported upon an internal shoulder 130 (FIGS. 10, 11) defined within the container.

Container 12 is preferably of substantially cylindrical construction, and is preferably made of glass or plastic. Alternative shapes and sizes are within the purview of the invention. The container has a lower reinforced base 26 adapted to be disposed upon a supporting surface for stowage. The wringer-saturator is preferably press-fitted into the container where it may frictionally seat itself. Preferably wringer-saturator 24 seats upon an internal shoulder 130 (FIGS. 10, 11) formed within the container, in which case other supports such as the previously described internal vertical rib supports 30 become unnecessary.

A plurality of radially spaced-apart, interior vertical supports 30 (FIG. 2) integral with the container 12 may be used to support the wringer-saturator partition 24. The supports 30, which may be disposed approximately 120 degrees apart about the radial inner periphery of the container 12, can support the wringer-saturator partition 24 when pressed unto them in assembly. Preferably the length of each interior ribbed support is approximately ⅔ of the height of the container. However, the shoulder design 130 (FIG. 12) is preferred.

The upper, reduced diameter hub portion 38 (FIG. 2) of the container 12 is preferably interiorly threaded, enabling threadable coupling to the lid 18 in assembly.

The preferred removable lid 18 comprises an integral, concentric, rim 40 whose inner peripheral surface 44 is threaded. This enables the lid 18 to be threadably attached to the container 12, by engagement with the complimentary, threaded hub portion 38. The lid and its rim may be adapted for snap fitting instead to a suitably configured container. In operation, lid 18 with rim 40 functions as a handle for applying fluids.

When the lid 18 is securely attached to or threadably tightened to the container 12, the downwardly projecting wiper 20, supporting a lower, peripheral fabric covering 21, is compressed slightly against the lower, wringer-saturator partition 24. Upon inversion of the container, then slight contact with the wiper 20 and liquid through the wringer saturator partition 24 is established. When turning back upright, the lid channels 123 (FIG. 12) described hereinafter facilitate the flow of liquid to the top of the wiper. The wiper covering prevents dripping during use. Moreover, with the fiberglass version of the covering, the human body experiences a smooth and gentle feeling when the wiper is drawn or rubbed softly over the skin.

Wiper 20 is generally cylindrical with an exterior surface, and may have somewhat the shape of a truncated cone. Wiper 20 is used for topical application of liquids within the container to the region or areas requiring treatment with the applicator contents. In the best mode the wipers comprise equine tack or hydro sponges available from Smartpak Equine LLC. Sponges can be ordered from https://www.smartpakequine.com.

The wiper 20 is "squashed" or compressed slightly against the wringer-saturator partition 24 in assembly, but it will will expand and hold liquid when released from compression by loosening and/or removing the container lid 18. Preferably the wiper is made from plant-based or synthetic sponge material, and it is resistant to corrosive chemicals. The wiper 20 may be other shapes. For example it may be generally cylindrical in shape with a circular, oblong, oval, or square cross section. Preferably wiper 20 extends concentrically from the bottom of the lid 18, to which it may be secured by fitting it within a circular ring similar to ring 125 (FIG. 12) described hereinafter, that projects from the lid bottom. The wiper 20 may also be secured by gluing or the like. When the wiper is secured via the ring 125, it may be easily "quick-changed" when applicator maintenance or repair is later desired. The wiper may be manually withdrawn from the ring for removal, and a replacement wiper may be easily, manually forced into the ring where it will be retained.

When the wiper 20 is compressed against the wringer-saturator partition 24, it will exhibit a "wringer" effect, wherein liquid that would otherwise be stored within it is squeezed out from pressure. The liquid also passes through wiper covering 21 that shrouds the bottom of wiper 20 and its bottom radial periphery 23. On the other hand, when the lid is slowly threadably twisted or otherwise detached and removed, the wiper 20 will expand slightly and suck in liquid for subsequent topical application, becoming somewhat saturated with liquid. The lid's underside channels 123 (FIG. 12), or reservoirs, are defined between raised ribs 131, 132 that form petal or flute-like boundaries. Covering 21 can become further saturated when liquids travel through the channels 123 to contact the top of the wiper (i.e., the space between the wiper top and the immediate underside of the lid). The wiper 20 with its cover will substantially retain liquids when in use, and with the described construction, dripping will be reduced or prevented in use, and the normal resulting messiness with typical old-style applicators is avoided.

Figure 2:
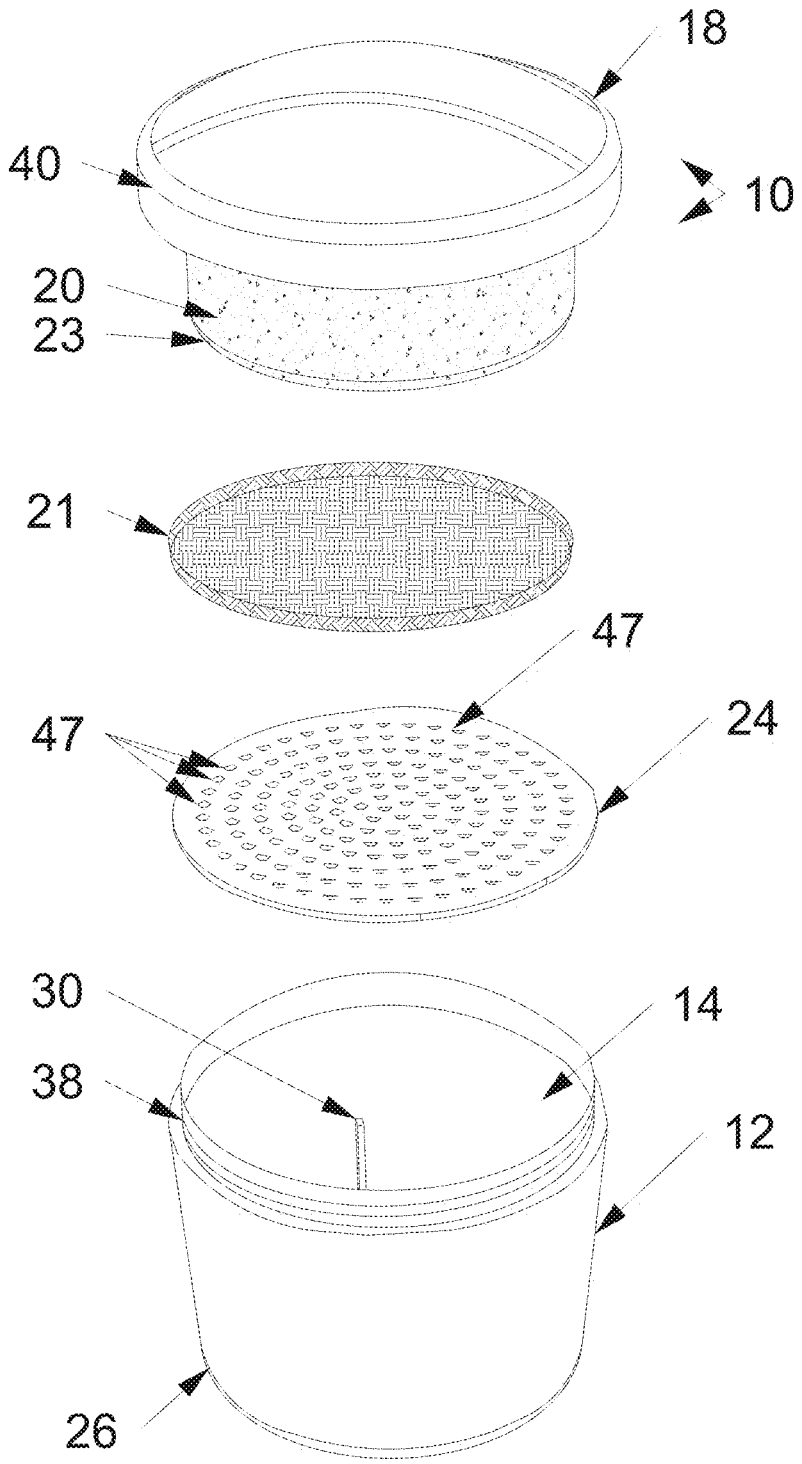
FIG. 2 is a partially exploded isometric assembly view of the applicator of FIG. 1.
Figure 3:
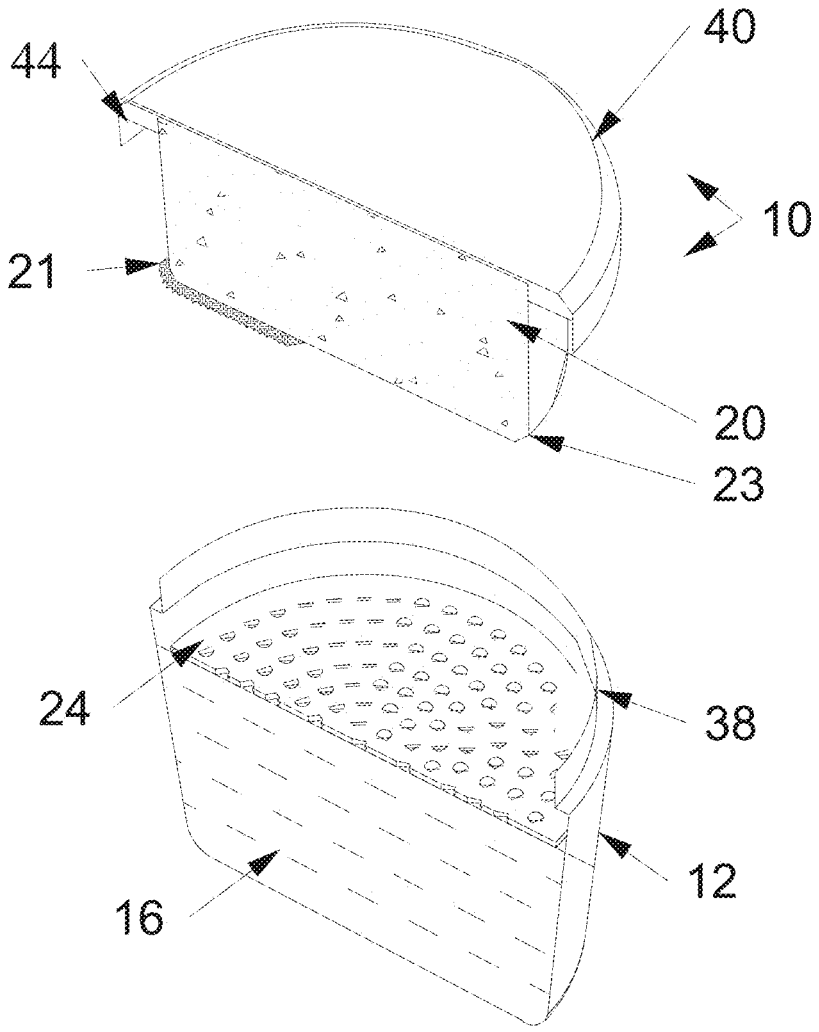
FIG. 3 is a fragmentary, partially exploded isometric view of the applicator of FIGS. 1-2, with portions thereof shown in section for clarity.

The preferred thin covering 21 on the bottom of wiper 20 surrounds at least the wiper exterior bottom periphery 23 (FIG. 2). In the preferred embodiment the shrouds the entire periphery of the wiper. This substantially circular covering 21 may be made from thin, fabric or garment materials such as polyester or linen, but preferably with a fiberglass pool lining. Covering 21 concentrically shrouds the bottom radial periphery 23 (FIG. 2) of the rim of the wiper 20 and the wiper's bottom surface. In use, the wiper 20 with its thin covering 21 ergonomically slides over exposed skin, and easily glides over all bony surfaces such as ankles, wrists, knees, etc.

The preferred wringer-saturator partition 24 is substantially circular, and is concentrically positioned within the container 12. The partition 24 is preferably frictionally seated within the container upon shoulder 130 (FIG. 10) but is may be supported within the container interior upon optional interior ribbed supports 30. The wringer-saturator partition 24 includes numerous orifices 47 for allowing controlled liquid passage between the container interior and the wiper 20.

The wringer-saturator partition 24 functions as a combination wringer and saturator. When the wiper 20 is compressed against the wringer-saturator partition 24, the effect is that of a wringer, with solution being squeezed out of the wiper 20. After inverting the container, the wiper will be wetted. When returned upright, liquid will be distributed evenly between the ribs 132 and channels 123 (FIG. 12), flowing through the lid channels between the ribs 132 and being evenly distributed into the wiper 20 and retained by its cover. When the container is back upright, the lid may be withdrawn from the container, and removal allows the wiper 20 to expand, drawing liquid into it and partially through covering 21, with the wiper 20 being saturated. While the lid is removed slowly by twisting, and with slight shaking of the container 12, the wiper 20 will become maximally saturated with liquid for subsequent topical application.

Figure 6:
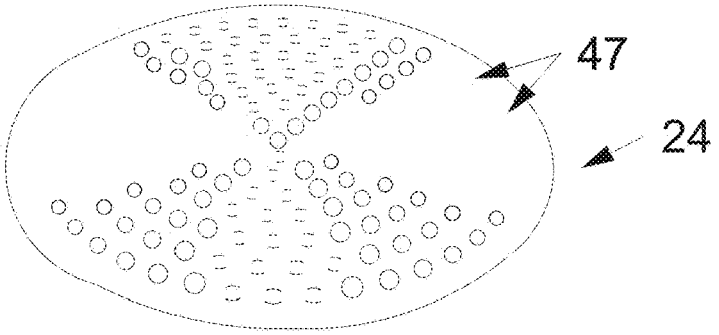
FIGS. 6-8 are enlarged isometric views of alternative wringer-saturator partitions.

The preferred wringer-saturator partition 24 includes a plurality of orifices 47 as mentioned. These orifices are preferably square or circular, although other geometries are possible, and are within the scope of the invention. The combined area of the partition orifices 47 (i.e., FIG. 6) is approximately twenty to sixty percent of the area of the partition, depending upon the viscosity of the interior gel fluid or repellent 16. Preferably there is a conventional peripheral gasket 49 defined about the outer circular periphery of the wringer-saturator partition 24, which facilitates firm seating of the partition when it is press-fitted within the container interior.

In the best mode known at this time, the lid 18, the wringer-saturator partition 24, and the container 12 may be molded from ultra-high molecular weight polyethylene (UHMWPE) plastic. It is thought that other thermoplastic materials may be used, as long as they do not dissolve or degrade when subject to the liquid contents. For example, PTFE (polytetrafluoroethylene) is a softer plastic that has excellent chemical resistance properties. A durable resin that emulates HDPE is acceptable for most fluids.

Figure 7:
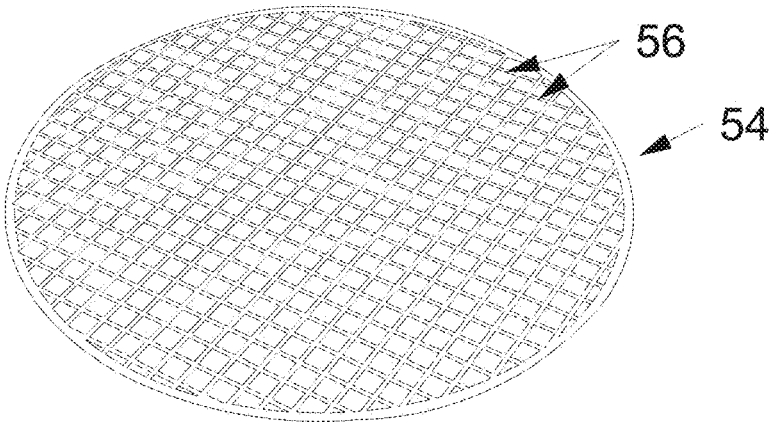

FIG. 7 shows an alternative wringer-saturator partition 54 that includes multiple orifices 56. However, this embodiment contemplates that the orifices 56 have a square profile. The combined area of the square partition orifices 56 (i.e., FIG. 7) is approximately ten to forty percent of the area of the partition 54, depending upon the viscosity of the interior fluid repellent 16.

Figure 8:
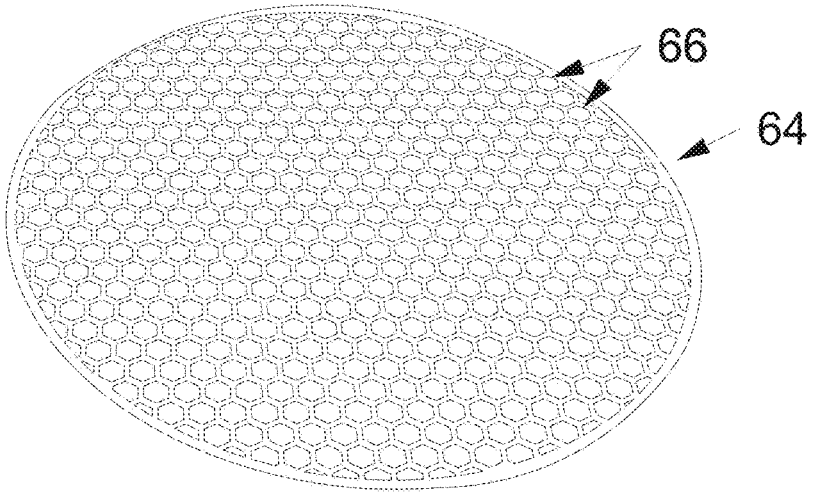

FIG. 8 shows another wringer-saturator alternative partition 64 that includes multiple honeycomb orifices 66. The combined area of the partition orifices 66 (i.e., FIG. 8) is approximately ten to forty percent of the area of partition 64, depending upon the viscosity of the interior fluid 16. Numerous other partition shapes may be used.

Figure 9:
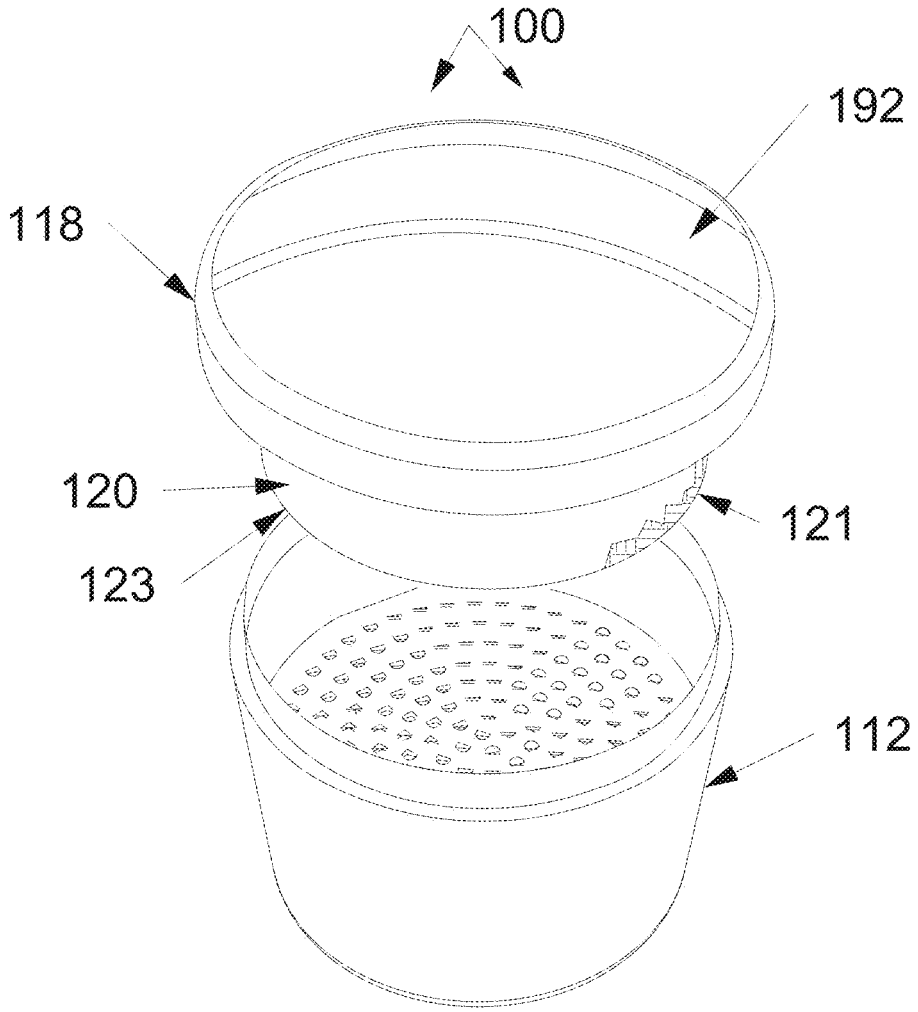
FIG. 9 is a partially exploded, isometric assembly view of a preferred applicator that has an enhanced wiper, with portions thereof broken away for clarity.
Figure 10:
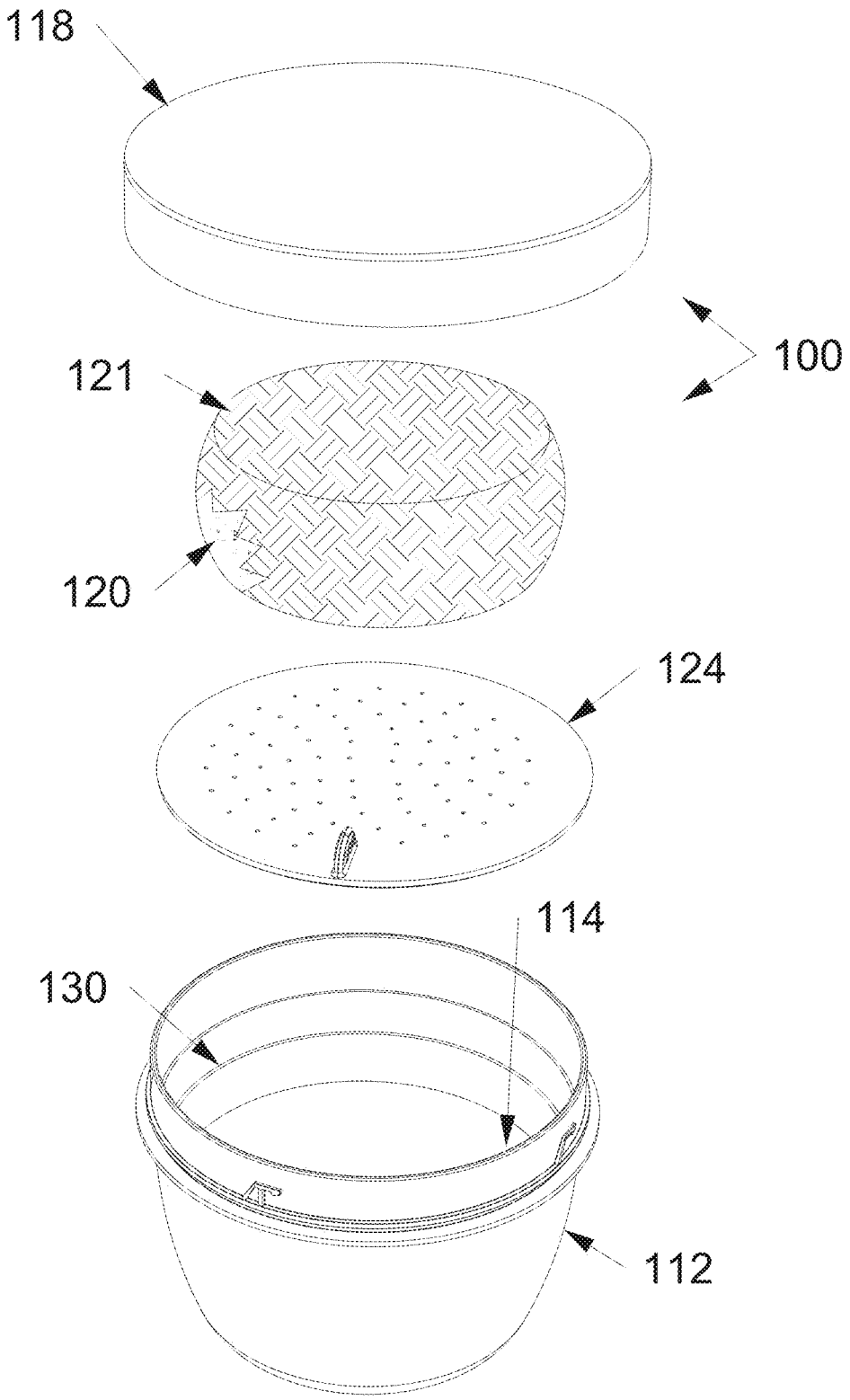
FIG. 10 is an exploded isometric view of the applicator of FIG. 9, with portions thereof broken away for clarity.
Figure 11:
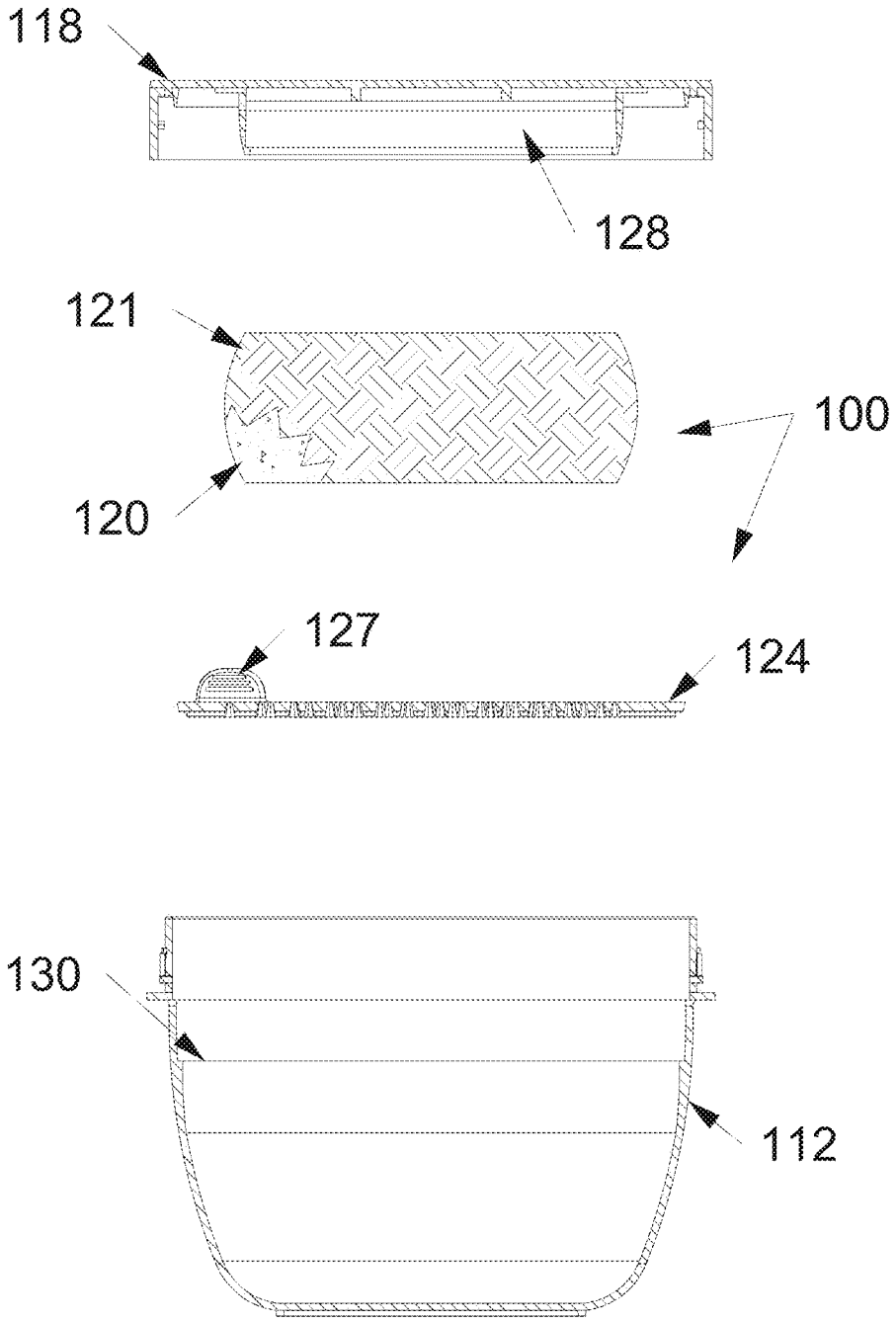
FIG. 11 is a partially exploded, elevational assembly view of the applicator of FIGS. 9-10; with portions thereof broken away for clarity; and, FIG. 12 is an enlarged, exploded isometric view showing a preferred wiper and the underside of the preferred lid which has been adapted to center and secure the wiper and to distribute fluid.

Referencing FIGS. 9-11, a preferred alternative applicator 100 has a different wiper covering than applicator 10 discussed earlier. The substantially circular lid 118 is adapted to be secured to the container 112 for closure. A sponge wiper 120 fastened to the lid bottom projects downwardly into the container interior 114. Wiper 120 is substantially similar to wiper 20 discussed earlier, except for the covering 121. The shrouding covering 121 may overly parts of the exterior surface of the wiper 120, or the entire exterior. Thus, while covering 21 (FIG. 1) shrouds just the lower bottom circular periphery of wiper 120, covering 121 preferably shrouds most, if not all, of the exterior surface of wiper 120 as seen in FIG. 10. Covering 121 is preferably made from fiberglass fabric material as aforedescribed.

In applicator embodiment 100, the lid 118 may optionally include a separate, integral handle portion 127 (FIG. 11).

Figure 12:
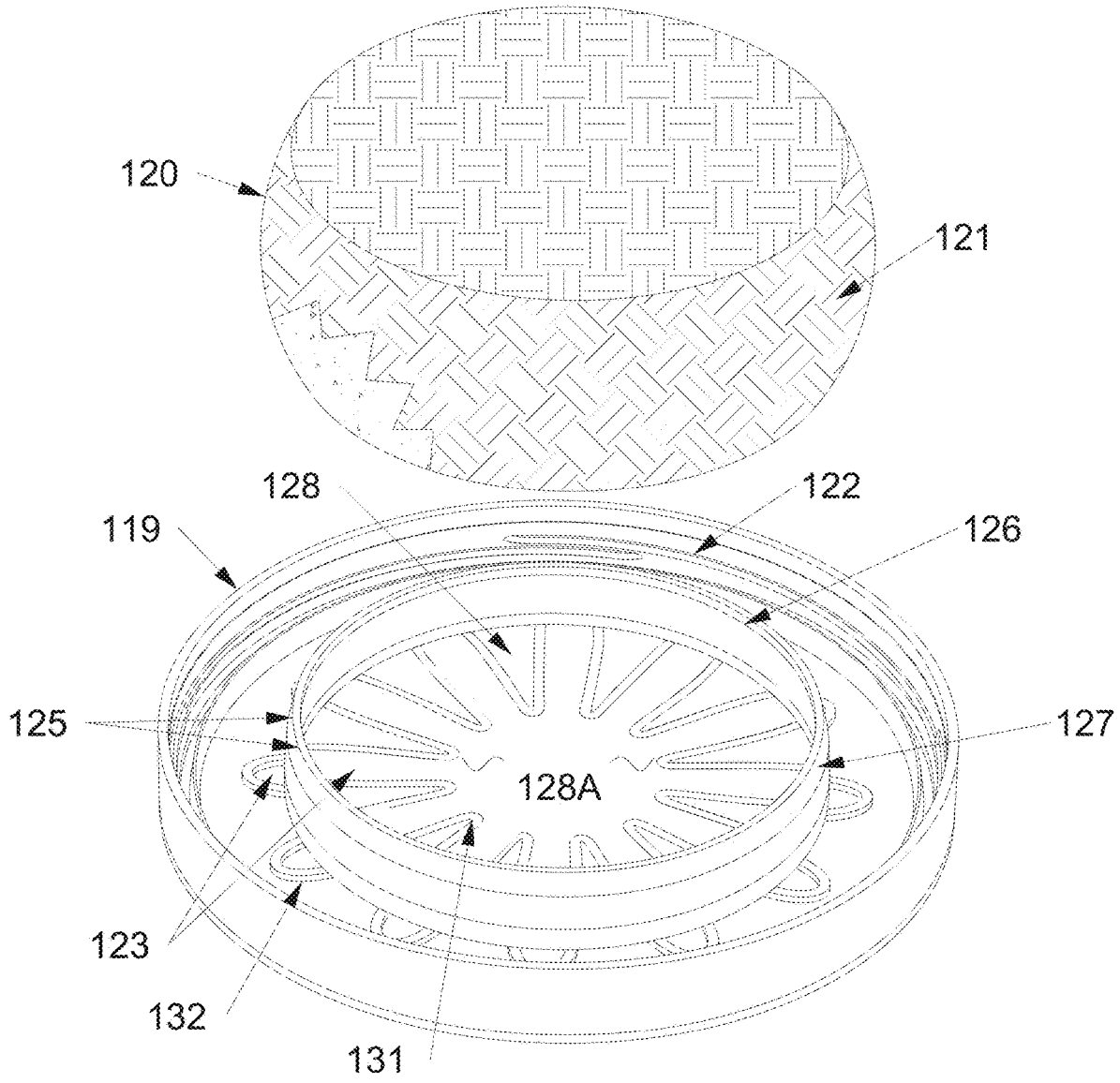

Noting FIG. 12, a preferred alternative lid 118 has an integral, interior, projecting mounting ring 125 concentrically formed on its underside 128. The inner periphery of the lid's rim includes threads 122. In FIG. 12 ring 125 appears to be projecting upwardly because the lid 118 is upside down. This somewhat tubular ring 125 circumscribes an inner wiper-mounting region 128A, disposed at the center of the lid underside. The wiper 120 fits snugly within and is secured by ring 125, so it is removable and may be cleaned easily. Alternatively it may be glued to the lid underside 128 and cradled upon and within wiper-mounting region 128A, being confined therewithin by contact with the periphery of ring 125, and by contact with reinforcing lip 127 and adjacent, inner compression band 126. Alternatively the wiper 120 may simply fastened by gluing to the lid underside upon region 128A.

Surrounding region 128 (FIG. 12) is a fluted region comprising a plurality of inner, raised ribs 131 and outer, complimentary and contiguous raised ribs 132. These form a pattern shaped somewhat like petals. These ribs reinforce the lid and create multiple surface points where the wiper may be fitted to the lid underside. Ribs 131 and 132 also define and border channels 123 that better facilitate controlled distribution of the interior fluids. Preferably ribs 131, 132 (FIG. 12) are raised, but in an alternative form of the invention they may instead be in the form of grooves in the lid underside surface that can direct and channel liquid. In another mode the raised ribs can resemble open tubes to direct fluid.

The raised ribs 131 and 132 have a fluted appearance resembling a flower petal, and their three dimensional character insures better fluid distribution. Furthermore, the channels 123 created and provided between the projecting ribs with their raised flute, petal construction can control and help circulate liquid to the wiper. The latter construction aids with more viscous liquids including bug repellents and sunscreen preparations, which tend to cling to the lid underside, preventing over-saturation of the wiper, and dripping therefrom. Depending upon the orientation of the applicator 100, liquid can be directed upon the upper portion of the wiper 120 when the applicator 100 is returned to an upright position after being substantially upside down. Preferably the wiper 120 is made from plant-based or synthetic sponge material, and it is resistant to corrosive chemicals. Alternatively, the wiper may be made from other synthetic materials including fabric designs.

In an alternative mode the ribs 132 could be made into little depressed channels formed in the lid underside like little rivers, or tubes, to distribute liquid.

Wringer-saturator 124, which is similar to wringer-saturator 24 (FIG. 1) discussed earlier, contacts and at least partially compresses wiper 120. The wringer-saturator 124 may be secured within the container 12 atop an inner shoulder 130 (FIG. 10) formed integrally with the container 112. Alternatively the wringer saturator may be secured within the container via a friction fit as it is pressed downwardly into the container. Also, the wringer-saturator 124 includes an integral, upwardly projecting lip 127 (FIG. 11) that enables grasping and manipulation tasks when necessary for cleaning or maintenance.

The interior liquid repellent or gel 16 (i.e., FIGS. 3, 4) normally fills the container interior up until contact with an internal partition. The liquid 16 contains insect repellent in a one to ten percent by volume mixture. With sufficient viscosity the liquid 16 is absorbed by the wiper 20 through the orifices in the previously described partitions. After inverting the container 12 and turning it back upright, the lid is then be manually grasped, and with wiper contact upon the skin of a user, for example, the repellent liquid may be evenly and cleanly spread upon a target area.

A preferred mode known to me for liquid 16, by weight, is a mixture as follows:

7%-1000% N,N-diethyl-m-toluamide (DEET);
40%-70% ethyl alcohol;
6%-7% Aloe;
3%-4% fragrance or perfume.

At this time best mode known to me for liquid 16, by weight, is a mixture as follows:

20%-50% N,N-diethyl-m-toluamide (DEET);
40%-70% ethyl alcohol;
6%-7% Aloe;
3%-4% fragrance or perfume.

Another example of a suitable liquid repellent mixture comprises a transparent insect repellent containing N,N-diethyl-m-toluamide (DEET), water, a solvent selected from a variety of lower alcohols including glycols, isopropyl alcohol, or ethanol, a gelling agent, methyl and propyl paraben, a perfume for masking the odor of the DEET, and a means for improving and stabilizing the texture of the liquid or gel 16. For the latter ingredient a polysorbate, preferably polyoxyethylene sorbitan monolaurate, is preferred for improving the texture of the gel.

Yet another example of a suitable repellent mixture is as follows:

a) from two to ten percent by volume a liquid containing N,N-diethyl-m-toluamide (DEET);
b) from forty to sixty percent by volume denatured water;
c) from thirty to seventy percent by volume a solvent selected from alcohols including glycols, isopropyl alcohol, or ethanol;
d) from two to ten percent by volume a stabilizer;
e) around five percent, an emollient skin cream.

Moreover, the invention works with common over-the-counter bug sprays and sun screens. For example, it has been successfully used with the following: OFF! family care insect repellent IV; OFF! defense insect repellent 2 with picaridin; OFF! botanicals insect repellent IV; Cutter Skinsations Insect Repellent; Babyganics natural insect repellent; Bug Soother with Lemongrass Oil; Neutrogena Ultra Sheer Face mist sunscreen spf 55; Neutrogena Invisible Daily defense face mist spf 50; Hawaiian Tropic AntiOxidant+ refresh sunscreen mist spf 30; and Bondi Sands The Australian Tan liquidgold self-tanning dry oil Coconut Scent.

A variety of traditional guidelines and/or instructions exist for the use of DEET-based products. Basic instructions known in the art are as follows:

1. The container should be held six to eight inches from skin or clothing, and application should employ a gentle sweeping motion.
2. Do not apply over cuts, wounds or irritated skin.
3. Do not apply in enclosed areas or inside the home; always do so outdoors.
4. Use just enough repellent to treat all exposed areas of skin.
5. Avoid over applicating the product. After applying product to exposed skin, evenly spread the product with a gentle rubbing by the hands to maximize protection.
6. Do not allow children to handle the product, and do not apply to children's hands. When using on children, apply to your own hands and then spread the product on the child.
7. Hands should be washed with soap and water after every application.
8. After applying to the palms of hands, products may be distributed upon and around the neck, ears, and face, while avoiding the eyes and mouth.
9. Do not spray product around or near food.
10. Always wash hands with soapy water before eating or drinking when wearing repellent even if there has been no recent application.
11. No children ten years old or less should apply bug repellents or sunscreen. These substances should be applied to children only by adults.
12. When using a spray or pump, no one should breathe the vapors.

Conversely, use of the instant applicator/dispenser eases the burden on the user. Steps like spraying the product, rubbing it in with the hands and having to follow-up by washing the hands, are often inconvenient and bothersome for many outdoor consumers. There are a large number of users that carelessly streak the product and do not follow other recommendations to spread it with the hands to attain total coverage of exposed skin that guarantees maximum protection. Unfortunately, far too many users actually avoid use of any repellent products or never rub it in because of spraying and application inconveniences and mess.

Finally, the importance of periodic reapplication of bug repellents and/or sunscreens cannot be emphasized enough. Reapplication is markedly critical every two to four hours on a long outing. With old fashioned spray cans and pumps, for example, periodic reapplication is largely ignored and/or omitted. Preventing toxicity from toxic bites and ultraviolet light becomes greatly simplified with my new applicator/dispenser. With the use of the instant invention, the traditional guidelines discussed above are relaxed dramatically.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiment's may be made of the invention without departing from the scope thereof, it is to be understood that all matter herein set forth or shown in the accompanying drawings is to be interpreted as illustrative and not in a limiting sense.

What is claimed is:

1. An applicator for use with substances to be topically applied to the body, the applicator comprising:

a container adapted to at least temporarily hold said substances, the container comprising an interior;
a lid adapted to be secured to the container for closure, the lid functioning as a handle when removed from said container, and wherein the lid comprises an underside;
a downwardly projecting wiper made from sponge material that is attached to the lid underside for dispensing and applying said substances, the wiper having a periphery;

a fiberglass covering shrouding a substantial portion of the wiper for preventing dripping during use and easing substance application;

a wringer-saturator disposed within said container that divides said interior and which at least slightly contacts said wiper when said lid is attached to said container, said wringer saturator comprising a partition with a plurality of orifices through which said substances may pass;

the wringer saturator seated upon supports disposed within said container;

whereby, when said lid is attached to said container, the wiper at least slightly compresses, and when the lid is removed the wiper may contact the body to apply said substances, with said fiberglass covering preventing dripping and ergonomically smoothing the feel of the applicator; and, wherein the lid comprises an inner bottom surface comprising a tubular ring for snugly receiving and removably mounting the wiper, the ring circumscribing a flat inner wiper-mounting region at the center of the lid underside, the wiper mounting region comprising a plurality of spaced apart, raised ribs with flat channels defined between said ribs for evenly distributing fluids and for preventing over-saturation of the wiper.

2. An applicator for topically applying substances to the human body, the applicator comprising:

a container for holding said substances, the container comprising an interior;

said substances elected from the group consisting of insect repellents, skin creams, body lotions, suntan lotions, liquid gels, and disinfectants;

a lid adapted to be secured to the container for closure, the lid functioning as a handle when removed from said container, and the lid comprising a bottom, and the lid bottom comprising a plurality of ribs defining channels for evenly distributing said substances;

a wiper projecting downwardly from the lid bottom for absorbing or dispensing said substances, the wiper having an exterior;

the wiper removably retained within a ring that is integral with said lid and which projects from the lid bottom, whereby the wiper may be removed and cleaned;

a covering substantially shrouding the wiper exterior for preventing dripping during use and easing and simplifying substance application the covering comprising a fiberglass lining for preventing dripping;

a wringer-saturator press-fitted into said container and seated upon an internal shoulder, the wringer saturator at least slightly contacting said wiper when said lid is firmly attached to said container, said wringer saturator comprising a plurality of orifices through which said substances may pass;

whereby, when said lid is attached to said container, the wiper slightly compresses, and during removal the wiper will absorb at least a portion of said substances and may thereafter contact the body and apply said substances, with said covering preventing dripping and ergonomically smoothing and easing the feel of the applicator; and, wherein said tubular ring circumscribes a flat, inner wiper-mounting region at the center of the lid underside, the wiper mounting region locating said raised ribs with flat channels defined between said ribs for evenly distributing fluids and for preventing over-saturation of the wiper.

3. A portable applicator for personal use with sunscreens, sun-tan lotions, and insect repellents that are to be topically applied to the human body, the applicator comprising:

a container adapted to at least temporarily hold the contents of said applicator, the container comprising an interior;

a lid adapted to be secured to the container for closure, the lid functioning as a handle when removed from said container, the lid comprising an inner bottom surface with flat channels defined between ribs for distributing fluids;

a projecting mounting ring defined on said lid bottom surface, wherein said ring circumscribes an inner, flat wiper-mounting region at the center of the lid underside, the wiper mounting region locating said ribs and flat channels defined between said ribs for preventing over-saturation of the wiper, the ribs formed in the general pattern of petals;

a downwardly projecting sponge wiper for contacting the body, the wiper being resistant to corrosive chemicals, and the wiper secured within said applicator by said mounting ring;

a covering shrouding the wiper for preventing dripping during use and comforting substance application, the covering comprising a fiberglass lining for preventing dripping;

a wringer-saturator disposed within said container and seated upon an interior shoulder that divides said interior and which at least slightly contacts said wiper when said lid is firmly attached to said container, said wringer saturator comprising a plurality of orifices through which substances may pass; and, whereby, when said lid is attached to said container the wiper slightly compresses, and when the lid is removed the wiper retains at least a portion of said substances, so that the wiper may contact the body to apply said substances, with said covering preventing dripping and ergonomically smoothing the feel of the applicator.

* * * * *